United States Patent [19]

Iwako

[11] 3,998,433

[45] Dec. 21, 1976

[54] CONTINUOUS MIXING MACHINE FOR MOISTENING POWDERED MATERIAL

[75] Inventor: Hiroyuki Iwako, Tokyo, Japan

[73] Assignee: Funken Co., Ltd., Tokyo, Japan

[22] Filed: May 12, 1975

[21] Appl. No.: 576,459

[30] Foreign Application Priority Data

May 10, 1974 Japan ..... 49-51856
July 25, 1974 Japan ..... 49-85398

[52] U.S. Cl. ..... 259/8; 259/24; 259/DIG. 30

[51] Int. Cl.[2] ..... B01F 7/16

[58] Field of Search ..... 259/7, 8, DIG. 30, 23, 259/24, 43, 44, 66, 67, 96

[56] References Cited

UNITED STATES PATENTS

| | | | |
|---|---|---|---|
| 2,498,209 | 2/1950 | Iredale | 259/DIG. 30 |
| 3,186,803 | 6/1965 | Akaboshi et al. | 259/23 |
| 3,502,305 | 3/1970 | Grun | 259/8 |
| 3,744,763 | 7/1973 | Schnoring et al. | 259/7 |

FOREIGN PATENTS OR APPLICATIONS

| | | | |
|---|---|---|---|
| 915,047 | 1/1963 | United Kingdom | 259/DIG. 30 |

*Primary Examiner*—Richard E. Aegerter
*Assistant Examiner*—Willis Little
*Attorney, Agent, or Firm*—Cooper, Dunham, Clark, Griffin & Moran

[57] ABSTRACT

Powdered material is fed downwardly into the mixing chamber through a vertical feed pipe while liquid is fed into the chamber in the form of annular thin film descending along the inner wall surface of an inverted frusto-conical overflow structure arranged in a liquid tank in encircling relation to the powder feed pipe. Accommodated in the mixing chamber is an agitator disc having a large number of upwardly extending projections co-operable with stationary projections formed on the top wall of the chamber. An annular board is placed afloat on top of the liquid in the tank substantially coaxially with the tubular overflow structure to serve the purpose of preventing any adverse effect of surface disturbance upon the formation of thin liquid film.

8 Claims, 4 Drawing Figures

CONTINUOUS MIXING MACHINE FOR MOISTENING POWDERED MATERIAL

BACKGROUND OF THE INVENTION

This invention relates generally to the mixing of powdered material with a predetermined proportion of water or other liquid.

For example, in the process of manufacturing Japanese noodle, vermicelli, spaghetti, macaroni or other pasta, flour is mixed with liquid ingredients such as water and oil in appropriate proportions. Previously, however, it has been extremely difficult to perform the mixing in any continuous operation and in practice the mixing operation has been performed in batches. For example, in the manufacture of Japanese noodle, a mixing time of from about 10 to 20 minutes per batch has usually been required and the paste or mixture obtained must be left to cure for about 30 minutes to several hours because of its lack of uniformity.

SUMMARY OF THE INVENTION

In view of these deficiencies inherent in batch operation, the present invention has for its primary object the provision of a continuous mixing machine which is designed to work on a powdered material on the way of its transportation, while adding a predetermined proportion of water or other liquid thereto, to produce a continuous stream of uniformly mixed paste or moistened mass.

A specific object of the present invention is to add a predetermined proportion of water or other liquid in a continuous fashion to a powdered material, particularly of such kind as wheat flour or other cereal grain powder, on the way of its continuous transportation, for example, through a line of conveyor tube, in order to obtain a properly moistened mass of such powdered material which may be processed in the next stage into noodle, vermicelli or the like form.

Other uses with which the apparatus may be put are also contemplated by the invention. For example, it is usable in various manufacturing plants to moisten dust recovered or collected for disposal with water or other liquid as it is carried out and thus enables automatic continuous densification of such dust for ease of handling. The apparatus may also be utilized in the manufacture of pneumatic tyres to moisten carbon black powder with processing oil thereby to eliminate the need for pelletizing and drying steps as previously required.

A further object of the present invention is to provide a continuous mixing machine for moistening powdered material which comprises a powder feed pipe connected with a line of powder conveyor tube, a pointed circular cone against which the powdered material to be moistened is ejected through the powder feed pipe so as to be dispersed radially around the circular cone, a liquid reservoir tank for holding a mass of water or other liquid, and a tubular overflow structure arranged fixedly in the liquid reservoir tank to allow the liquid to overflow as a thin film descending along the inner wall surface of the structure effectively to intermingle with the dispersed powdered material.

Yet another object of the present invention is to provide a mixing machine of the character described which further comprises an annular board lying afloat on the surface of the mass of liquid held in the liquid reservoir tank closely around the top circumferential edge of the tubular overflow structure to prevent any disturbance of the liquid surface close thereto thereby to make sure and steady the formation of thin film of liquid along the inner wall surface of the frusto-conical overflow structure.

These and other objects, features and advantages of the present invention will become apparent from the following description when taken in conjunction with the accompanying drawings.

DESCRIPTION OF THE PREFERRED EMBODIMENTS

Figure 1:
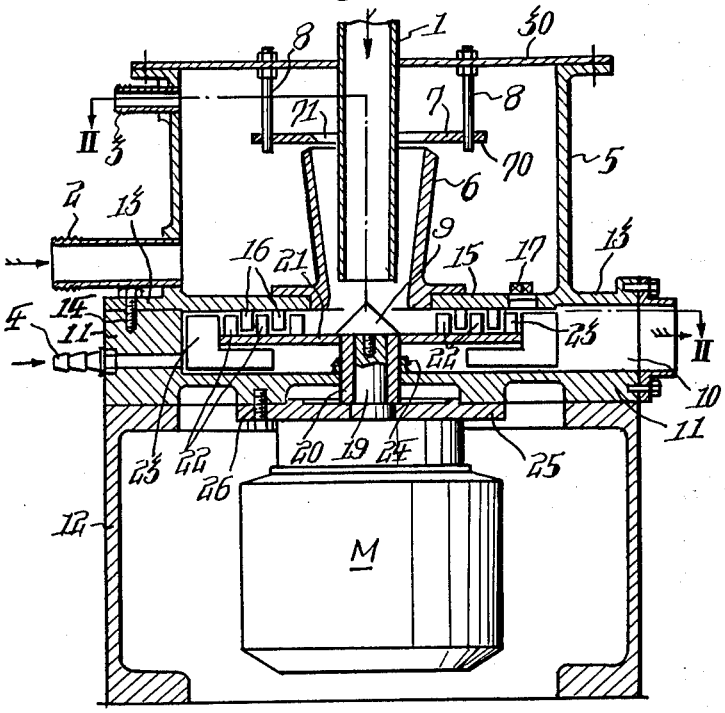
FIG. 1 is a longitudinal cross-sectional elevation of one preferred embodiment of the invention.
Figure 2:
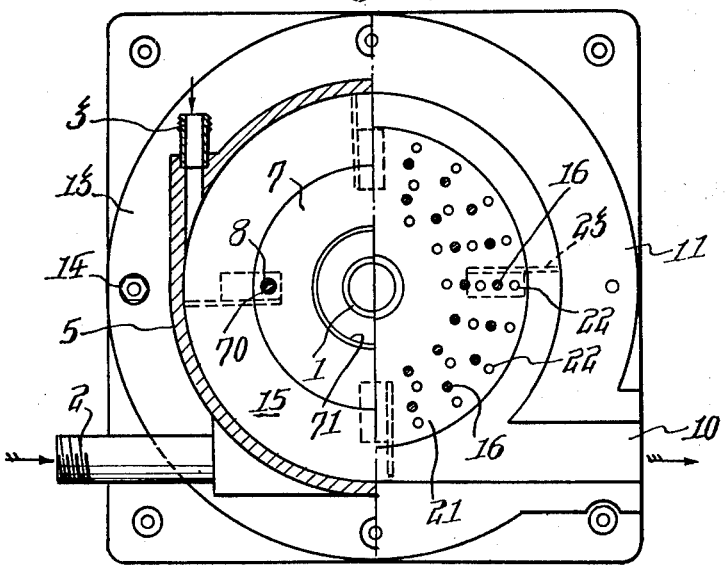
FIG. 2 is a plan view, partly in section, taken substantially along the line II—II in FIG. 1.

Referring to FIGS. 1 and 2, which illustrate a first embodiment of the invention, reference numeral 1 indicates a powder feed pipe connected at one end with a line powder conveyor tube (not shown) on the upstream side thereof and depending into the illustrated machine axially thereof; and 10 indicates an outlet or delivery port formed in the body 11 of the machine sidewise thereof and connected with the line of powder conveyor tube on the downstream side thereof. As illustrated, the machine body or casing 11 is mounted on top of a pedestal frame 12, which accommodates a drive motor M in a vertical position, and secured to the frame by means of a number of fastening bolts 26. A liquid reservoir tank 5 is mounted on top of the casing 11 and is formed with an annular bottom flange 13, which is secured to the casing by means of a number of fastening bolts 14. The casing 11 is generally flat on top and bottom and cup-shaped to define a mixing chamber of the machine, in which are coaxially accommodated an upwardly pointed circular powder-dispersing cone 9 and an agitator disc, which will be described hereinafter in further detail.

Fitted in a bottom portion of the side wall of the reservoir tank 5 is a liquid inlet pipe 2 which opens into the tank 5 tangentially thereof and serves the purpose of continuously feeding the tank with water or other liquid to be added to the powdered material. As seen in FIG. 1, a tubular overflow structure 6 of inverted frusto-conical shape is arranged in the reservoir tank 5 axially thereof and fixed to the bottom wall 15 of the tank in encircling relation to the powder feed pipe 1, through which the powdered material is ejected downwardly. As shown, the tank bottom wall 15 is axially apertured to fittingly receive the bottom end of the tubular overflow structure 6.

With this arrangement, as water or other liquid is fed through the inlet pipe 2 to the liquid tank 5 continuously at a predetermined rate, there is formed over the top circumferential edge of tubular overflow structure 6 a continuous flow of liquid which runs down the inner wall surface of the structure in the form of a generally annular sheet or thin film of liquid.

The drive motor M is mounted on the underside of casing 11 centrally thereof by means of a mounting, plate 25, which is secured to the casing 11 by a number of fastening bolts 26. Connected with the output shaft of drive motor M is a drive shaft 19 which extends vertically upwardly into the mixing chamber defined in the casing 11 and to the top of which shaft the circular cone 9, having an apex angle of 90° is fixedly secured as by thread means. The agitator disc 21 previously referred to is formed with a downwardly extending hub 20, which is firmly fitted over the drive shaft 19, and is rotatable therewith.

As seen in FIG. 1 and in the right-hand half of FIG. 2, the agitator disc 21 is formed on its top surface with a multitude of upwardly extending projections 22, for example, arranged in three circumferential rows around the disc axis. For cooperation with these projections 22, a multitude of downwardly extending projections 16 are formed on the underside of the bottom wall 15 of liquid tank 5 in such an arrangement, for example, in two circumferential rows, as to allow the upwardly extending projections 22 to run clear of the stationary projections 16 and in close proximity thereto, substantially in the same manner as with the case of well-known forms of impact grinder.

The agitator disc 21 also has a number (for example, four as shown) of fan blades 23 fixed to the periphery thereof in circumferentially spaced relation to each other. These blades 23 are each positioned in a plane extending vertically and radially of the agitator disc 21 and serves to expedite its rotation under the effect of air flowing from an auxiliary air inlet pipe 4, which will be described hereinafter, and to forcefully propel the moist mixture formed in the mixing chamber to the delivery port 10.

In operation, powdered material to be moistened is fed continuously through the vertical feed pipe 1 to fall on the rotating circular cone 9 and dispersed radially thereof. On the other hand, the liquid fed to the bottom portion of liquid tank 5 through the inlet pipe 2 rises to flow over the top circumferential edge of tubular overflow structure 6 and down the inclined inner wall surface thereof in the form of thin film to intermingle with the powdered material fed down into the mixing chamber and dispersed radially around the pointed circular cone 9. The liquid and powdered material thus fed in the mixing chamber are agitated by the agitator disc rotating therein and under the impacting action of co-operating movable and stationary projections 22 and 16, respectively, formed on the agitator disc 21 and on the underside of the liquid tank 5 in substantially the same horizontal plane, and in this manner are thoroughly mixed together to form a uniform moist mixture, which is delivered through the delivery port 10 into the conveyor tube connected therewith under the action of fan blades 23 secured to the agitator disc 21.

Further, in this embodiment, the liquid tank 5 is provided with an air inlet pipe 3 connected to a top portion thereof so that air may be fed continuously into the space in the tank above the liquid level therein. The air fed is forced to flow down rapidly through the limited annular space between the bottom end portion of powder feed pipe 1 and the adjacent inner wall surface of the inverted frusto-conical overflow structure 6, thus acting to suck the powdered material downwardly from the feed pipe 1 and ensure that the material delivered therefrom is thrown down directly to impinge against the rotating pointed circular cone 9. With this arrangement, it will be readily appreciated that the dispersing effect of the circular cone 9 upon the impinging powdered material is much larger than that obtainable with prior art apparatus, enabling the material to be mixed with the liquid of thin film form with improved efficiency, and that the flow of air to the outlet port 10 makes the delivery of the mixed moist material extremely smooth.

Further, the reservoir tank 5 is provided with a top cover plate 30 which has a pair of vertically downwardly extending guide rods 8 secured thereto in diametrally opposite positions. An annular float board 7 is loosely fitted over the guide rods 8 for vertical sliding movement relative thereto and has an inner peripheral edge 71 of a diameter substantially equal to the inner diameter of the top end of tubular overflow structure 6 and lying immediately above the top edge thereof. Reference numeral 70 indicates a pair of apertures formed in the annular board 7 and each having a diameter slightly larger than that of guide rods 8. As will readily be understood, the annular board 7 is free to move up and down in response to any minute variation of the level of liquid in the reservoir tank 5 under the effect of surface tension of the liquid. It is to be understood that the annular board 7 is made of a synthetic resin or other material having such a specific gravity as enabling it to lie afloat on the surface of the liquid, e.g., water, held in the reservoir tank 5 in a position adjacent to the top circumferential edge of tubular overflow structure 6 and in this manner serves the purpose of preventing any disturbance of the surface of liquid in reservoir tank 5, such as may be caused by pulsation of the liquid flow entering through the fluid inlet pipe 2, from reaching the top edge of the tubular overflow structure 6 thereby to help formation of thin liquid film along the inner wall surface of the structure.

As referred to hereinbefore, an auxiliary air inlet pipe 4 is arranged to open into the mixing chamber defined by the casing block 11 and the auxiliary air entering therein not only acts upon the fan blades 23 to help rotate the agitator disc 21 but also to help drive the powdered material moistened to a predetermined extent outwardly through the delivery port 10. In FIG. 1, reference numeral 17 indicates a drain plug fitted in the bottom wall 15 of the fluid tank 5.

Figure 3:
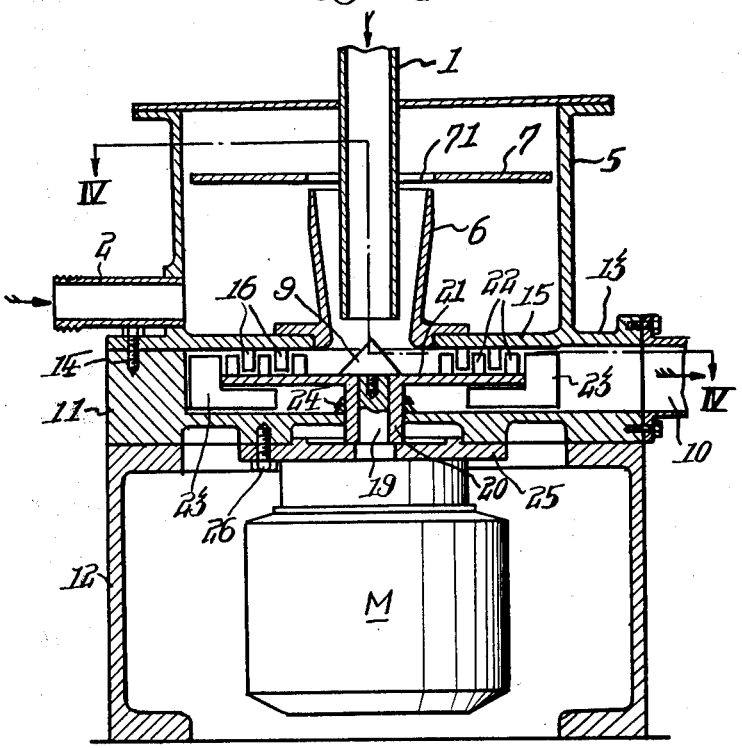
FIG. 3 is a view similar to FIG. 1, illustrating another preferred embodiment of the invention.
Figure 4:
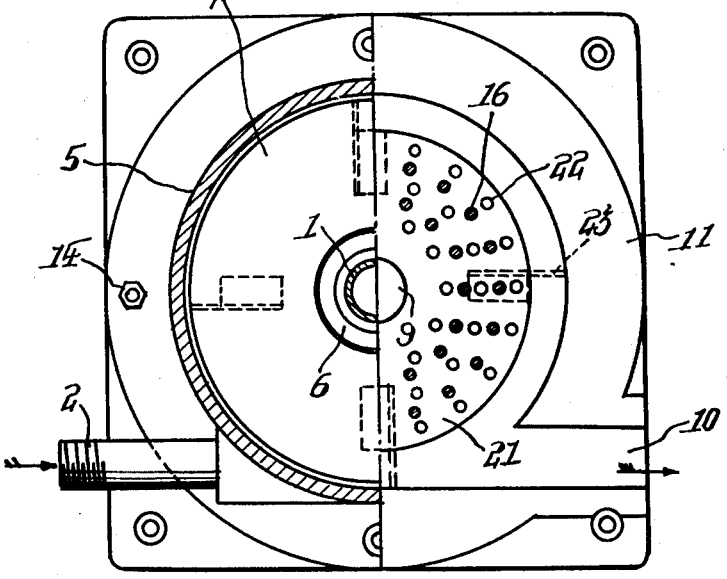
FIG. 4 is a cross-sectional view taken substantially along the line IV—IV in FIG. 3.

Illustrated in FIGS. 3 and 4 is a second embodiment of the present invention, which is basically of the same structure as that of the first embodiment shown in FIGS. 1 and 2 except that the air inlet pipe 3 and auxiliary air inlet pipe 4, respectively connected to the fluid tank 5 and to the mixing chamber are omitted and includes, as illustrated, components such as a powder feed pipe 1, an inverted frusto-conical overflow structure 6, a rotatable powder-dispersing cone 9, an agitator disc 21 having fan blades 23 arranged around the periphery thereof and carrying a multitude of upwardly extending projections 22 to co-operate with a multitude of downwardly extending stationary projections 16 provided in the mixing chamber, and a delivery port 10 through which the flour or other powdered material mixed with a predetermined proportion of moistening liquid is finally discharged from the mixing chamber in a continuous fashion.

In the second embodiment, however, an annular float board 7 modified in structure for convenience in practice is employed to serve the purpose of enabling formation of thin liquid film free from any adverse effect of disturbance of the liquid surface in the reservoir tank 5. Namely, in this modification, vertical guide rods 8 provided in the first embodiment to guide the annular board 7 vertically are eliminated and, as seen in FIG. 3, the modified annular board is made with an outer diameter slightly smaller than the inner diameter of the reservoir tank 5 and placed therein to float freely, covering substantially the whole area of the liquid surface. As with the case of the first embodiment, the opening 71 in the center of the float board 7 has a diameter substantially equal to the inner diameter of the top end of the frusto-conical overflow structure 6. Accordingly, the float board 7, being formed of a material having an appropriate specific gravity, lies afloat on top of the liquid, such as water, held in the reservoir tank 5 to cover substantially the whole area of the liquid surface in equilibrium with the surface tension and, in this manner, serves effectively to prevent the liquid surface from being disturbed even if the flow of liquid entering the tank through the inlet pipe 2 be pulsating, for example, under the effect of pump means used. Thus, the liquid rising to the level in the reservoir tank 5 can flow gently and smoothly into the tubular overflow structure 6 through the annular space defined between the inner peripheral edge 71 of the annular float board 7 and the top circumferential edge of the overflow structure 6, in the form of thin film descending along the inner wall surface of the frusto-conical overflow structure 6, as with the case of the first embodiment shown in FIG. 1.

While a few preferred embodiments of the present invention have been shown and described, it will be apparent to those skilled in the art that many changes and alterations may be made therein without departing from the spirit of the invention or from the scope of the appended claims.

What is claimed is:

1. A continuous mixing machine for adding a predetermined proportion of liquid to powdered material including: a liquid reservoir tank (5) provided with a liquid inlet pipe (2) to be continuously fed with liquid therethrough, a tubular overflow structure (6) of inverted frusto-conical shape fixedly arranged in said liquid reservoir tank centrally thereof so as to enable the liquid fed to said liquid reservoir tank (5) to flow over the top circumferential edge of said tubular overflow structure (6) and down the inner wall surface thereof, a vertically extending powder feed pipe (1) adapted to receive powder from a conveyor tube or the like and opening at the bottom to the interior space of said tubular overflow structure, means defining a mixing chamber below and adjacent the bottom openings of the powder feed pipe and the overflow structure, a pointed circular cone (9) arranged in the mixing chamber vertically opposite to the bottom opening of said powder feed pipe (1) and adapted to be driven to rotate about its own axis to radially disperse the powdered material delivered from said powder feed pipe, an agitator disc (21) arranged in the mixing chamber of the machine to rotate with said pointed circular cone (9) and operable to mix the dispersed powdered material with the liquid entering the mixing chamber through said tubular overflow structure (6) along the inner wall surface thereof and a device for facilitating the overflow of liquid into said tubular overflow structure (6) in the form of thin film descending along the inner wall surface thereof, said device including an annular board (7) having a circular opening (71) of a diameter substantially equal to the inner diameter of the top end of said tubular overflow structure (6) and arranged around and closely adjacent to the top thereof for free vertical movement with the level of liquid in said reservoir tank (5) to reduce disturbance of the surface of the liquid adjacent to the top of said tubular overflow structure (6), thereby aiding formation of the thin liquid film down the inner wall surface of said tubular overflow structure.

2. A machine as set forth in claim 1 wherein said annular board (7) is formed with a plurality of guide holes (70) and the machine includes a corresponding number of guide rods (8) loosely fitting through said holes to allow vertical movement of the board relative thereto, said guide rods (8) being secured to the top cover (30) of said liquid reservoir tank (5) and extending vertically downwardly therefrom.

3. A machine as set forth in claim 1, further comprising air inlet means (3) connected to a top portion of said liquid reservoir tank (5) to feed air into the space above the level of liquid therein at a rate such that the air is forced to flow rapidly through the annular space between said powder feed pipe (1) and the inner wall surface of said tubular overflow structure (6) to facilitate delivery of the powdered material from said powder feed pipe (1) under the suction effect of the air flow directly against said pointed circular cone (9).

4. A continuous mixing machine comprising:

a tank having a wall and an inlet extending through said wall;

an open top overflow structure disposed within said tank to provide an annular space between the tank wall and the overflow structure, into which space liquid entering the tank through said inlet can circulate, the overflow structure having an upper edge, a bottom outlet and an inner surface shaped to form a descending film of liquid which has circulated in said annular space and has risen to and overflown the upper edge of the overflow structure, wherein the inner surface of the overflow structure converges in the downward direction;

material inlet means to admit into said tank and into said overflow structure a material of a type capable of being dispersed into said liquid;

an annular board disposed in the tank for free movement up and down therein, said board being made of a material which is lighter than said liquid so as to move up and down with the level of the liquid in the tank, the board being closely adjacent the upper edge of the overflow structure when the liquid is overflowing said upper edge so as to reduce disturbance of the surface of the overflowing liquid and to thereby aid the formation of the descending film of liquid;

first dispersing means adjacent said material inlet means to disperse and distribute the admitted material into the descending liquid; and second dispersing means disposed along the path of the mixture of liquid and the material dispersed in the liquid by said first dispersing means for further mixing said mixture.

5. A continuous mixing machine as in claim 4 wherein said annular board is formed with a plurality of guide holes and the machine includes a corresponding number of guide rods extending vertically downwardly adjacent the upper edge of the overflow structure, said guide rods secured at one end to the machine in fixed relation with the tank and extending through said guide holes in the annular board to allow said board to move vertically along a defined path relative to the guide rods.

6. A continuous mixing machine as in claim 4 wherein said annular board has a central opening shaped and dimensioned to be substantially equal to the opening defined by the upper edge of said overflow structure and an outer periphery shaped and dimensioned to be immediately adjacent the inner wall of the tank, whereby the annular board substantially covers the surface of the liquid in the annular space between the tank and the overflow structure while the liquid is overflowing said structure.

7. A continuous mixing machine as in claim 4 including an air inlet into the tank above the level of liquid therein, and wherein the material inlet means is positioned in coaxial relationship with the overflow structure, whereby when air is fed through the air inlet at a rate such that it is forced to flow rapidly through the annular space between the material inlet means and the inner surface of said overflow structure the admitted material is delivered from said material inlet means under a suction effect of the air flow directly against the first dispersing means.

8. A continuous mixing machine as in claim 4 wherein the first dispersing means comprises a pointed circular cone which is adapted to be driven to rotate about its own axis and is disposed vertically opposite to the bottom opening of said material inlet means and below the bottom outlet of said overflow structure.

* * * * *